United States Patent [19]

Vrettos

[11] Patent Number: 4,787,017

[45] Date of Patent: Nov. 22, 1988

[54] MEMORIAL LIGHT

[75] Inventor: Steve Vrettos, Toronto, Canada

[73] Assignee: Panta Fos Enterprises Inc., Toronto, Canada

[21] Appl. No.: 167,577

[22] Filed: Mar. 14, 1988

[51] Int. Cl.[4] ..... F21L 19/00

[52] U.S. Cl. ..... 362/161; 362/368; 206/573

[58] Field of Search ..... 362/145, 154, 161, 162, 362/253, 266, 368, 806; 40/124.5; 52/103, 104; 431/296; 206/573

[56] References Cited

U.S. PATENT DOCUMENTS 2,072,692 3/1937 Valle ..... 362/161

*Primary Examiner*—Stephen F. Husar

*Attorney, Agent, or Firm*—Sim & McBurney

[57] ABSTRACT

A memorial light system for housing a candle comprises a base box with a lid to provide access therein. The lantern body houses a candle. The lantern body has a door to permit placement of a candle within the lantern body. The lantern body has a base plate with means on the base plate and on the lid for releasably connecting the lantern body to the lid of the base box. When not in use, the lantern body may be housed in the base box with the lid secured shut to protect the lantern from the elements and to provide a tidy appearance at the grave site.

7 Claims, 4 Drawing Sheets

FIG.1.
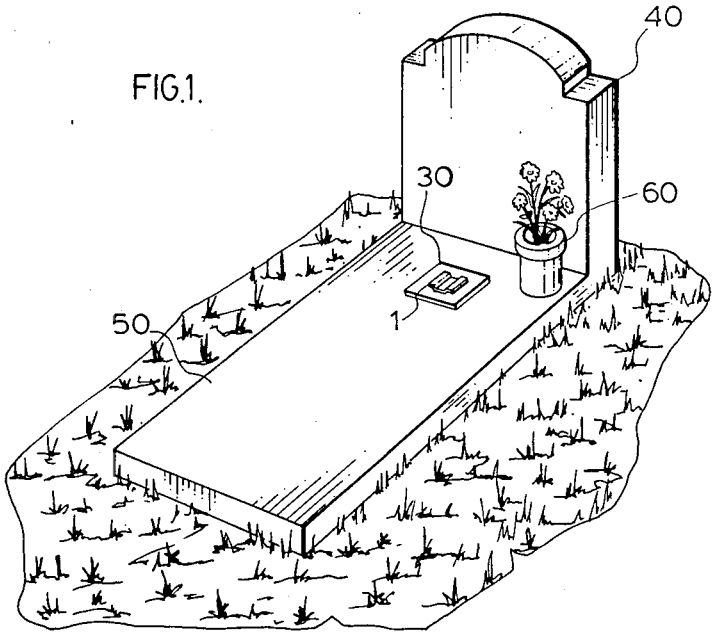
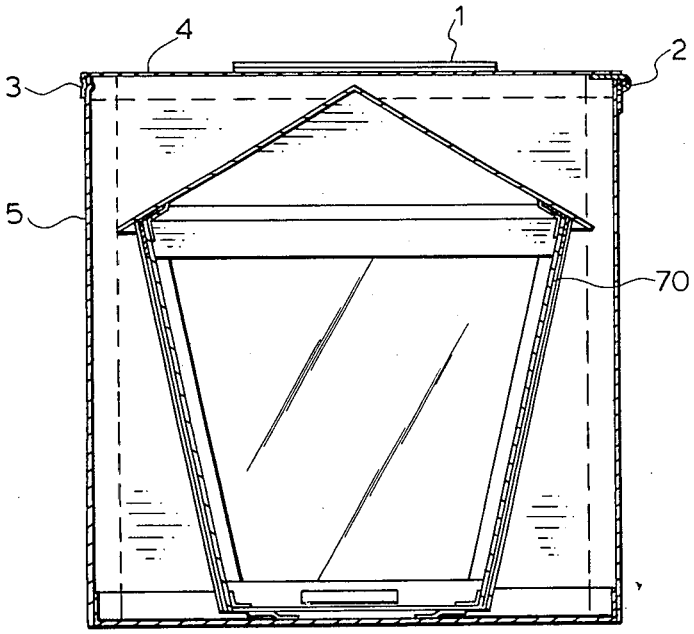
FIG.2.

FIG.5.
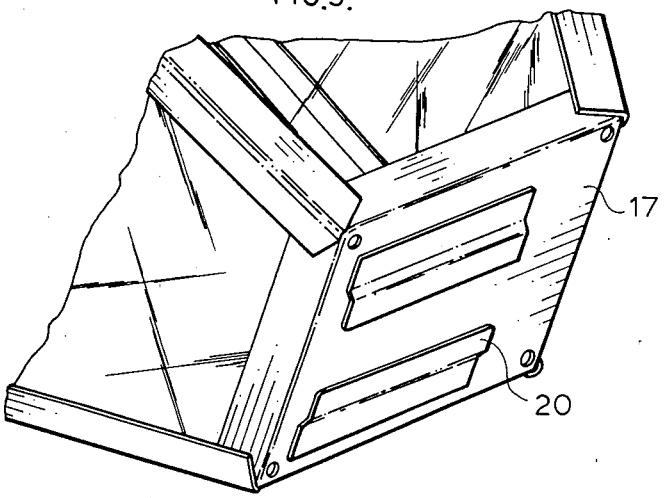
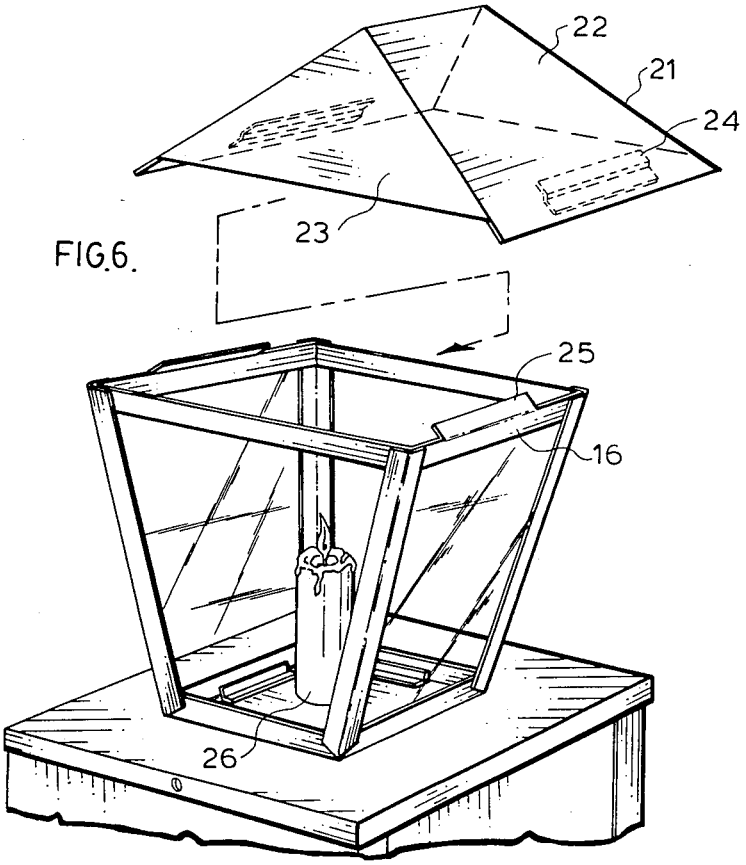
FIG.6.

MEMORIAL LIGHT

The invention relates to a new and novel memorial device for symbolizing the memory of a deceased person. In particular, it is an improved device by which the burning of memorial candles for illumination can be achieved.

In general, when candles are burned in cemeteries or other outdoor places, weather conditions frequently interfere with their continuous operation. Accordingly, it would be an advantage to have a memorial light that provides adequate shielding of the flame from the wind and rain so that they are adapted for continuous burning at any and at all times.

Furthermore, if weather conditions permit the full burning of a unshielded candle, it usually leaves a waxy residue on whatever it is mounted.

In particular, if it is affixed to a headstone or mausoleum, the candle leaves a messy residue and stub and must subsequently be scraped off. Similarly, if placed at the foot of a grave (on the ground) it has great potential to start a grass fire. The result of this candle placement is higher grounds maintenance costs.

A variety of memorial lights are available such as that disclosed in U.S. Pat. No. 3,376,413 to W. J. Peters. A battery operated memorial light is mounted in the earth or on a memorial tablet. However, battery operated lights are least preferred by the general public.

U.S. Pat. No. 2,072,692 to S. D. Valle contemplates an ornamental shielded memorial candle with emphasis on proper air circulation and adaptability to different sized candles.

U.S. Pat. No. 4,260,365 to M. L. Kayne contemplates a candle lamp with emphasis on removably attaching a container with wax therein (candle) to a socket and holder.

U.S. Pat. Nos. 1,975,496 to F. J. Barrett and 2,056,605 to C. D. Guilfoil teach the design of sanctuary lamps designed to permit burning of candles. The important feature is that the burning of the candles is controlled to maximize burning time and to substantially consume all of the candle material. Barrett teaches a candle holder containing a candle enclosed in cellulose whereas Guilfoil teaches a candles mounted within a chimney and utilizing a glass candle follower to control paraffin consumption.

U.S. Pat. No. 314,725 to J. H. Bonner teaches a folding lantern having hinged sides and recessed top and bottom which holds the sides in shape. Similarly, U.S. Pat. No. 847,429 to J. A. McCoy teaches a collapsible lantern for portably using candles to illuminate. The principle object is to provide a simple conveniently carried article with which to shield burning candles.

In accordance with this invention a system is provided to contain candle wax within the lantern where it may easily be removed by the next user. Furthermore, the flame itself is contained within the lantern and the risk of grass fires is eliminated.

The system of this invention provides a memorial light device which may be installed or set into the earth around a grave or onto a tablet or headstone. In such a position it is securely supported and can be readily observed by those in its vicinity.

More particularly, the invention embodies a device composed of an inert material such as stainless steel thus imparting long wearing and ever attractive, maintenance free properties to the device. A further advantage of the invention is ease of removal from its display position. The system has means by which the candle containing part (the lantern) is releasably and slidably attached to a box-type base so that the curator of the cemetery or some other such person may remove the lamp and put it out of sight into its base box. When it is not used for memorial purposes, the lantern is safely stored within the base free from risks of weather and other possible damage.

In accordance with an aspect of the invention, the memorial light system comprises a base box with a lid to provide access therein and a lantern body for housing a candle. The lantern body has a door to permit placement of a candle within it. The lantern body has a base plate with means by which the lantern body is releasably connected to receptive cooperating means mounted on the lid of the base box.

The aspects of the invention can best be understood from the following detailed description taken in connection with the accompanying drawings.

FIG. 1 is a perspective view of a preferred placement of the base and storage box in a grave site.

FIG. 2 is a side view of the candle containing part of the invention (the lantern) as stored in the base box which is shown in a cutaway view.

FIG. 5 is a perspective view of the bottom of the lantern part showing the slidable, releasable components.

FIG. 6 is a perspective view of the lantern as mounted on the base box showing how the top of the lantern may be slidably removed to place and light the candle within.

DETAILED DESCRIPTION OF THE DRAWINGS

Figure 3:
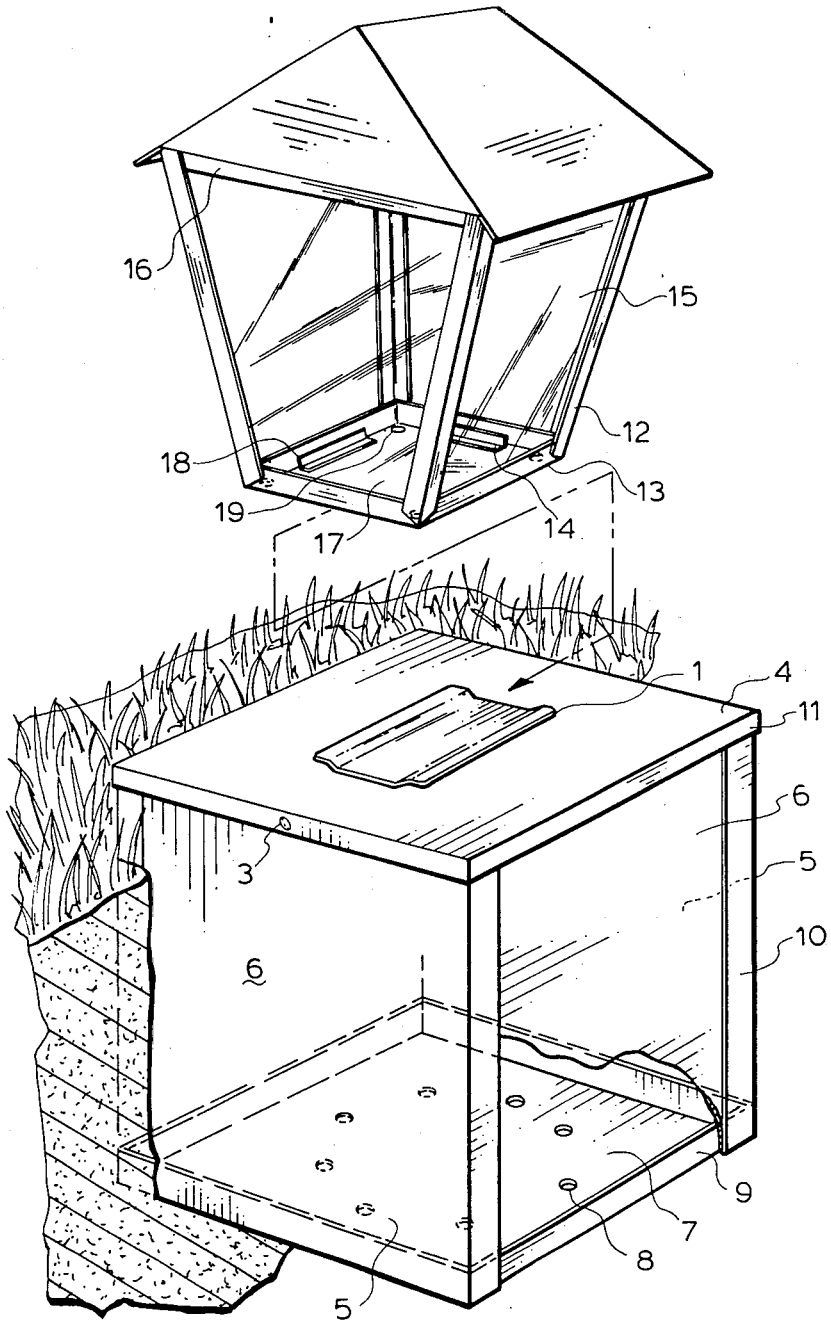
FIG. 3 is a perspective view of the base box as it is to be mounted in the earth also showing how the lantern part is releasably slidably attached to it.

As seen in FIG. 1, the base box 30 is in a preferred position relative to the headstone 40 and in the grave covering material 50. In this position, there is enough clearance between the lid of the base box and the level of the ground for the base box to be readily noticed by those who might wish to light a candle in memory of the deceased. Furthermore, grounds keepers can also be put on guard when operating lawnmowers and other ground grooming equipment. It must also be understood that the base box 30 is mounted in the grave covering material 50 beside the flowers 60. The base box is recessed in the grave covering material 50. It is appreciated that the unit may be located in other positions as desired.

Referring now in particular to FIG. 2, it can be seen how the base box 30 is made a size suitable to accommodate the lantern 70. Thus the lantern may be securely enclosed within the base box with the hinged lid 4 in its closed position. The lid 4 of the base box 30 is hinged to one side by using a piano hinge or such other suitable hinging mechanism which is welded or rigidly held using some other fastening means to the top of the side wall 6 of the box and the edge of the lid 4. The latching means 3 is located on the edge of the lid 4 opposite from the hinge edge. The preferred embodiment of the latch utilizes a detent which has been punched into the side wall 5 which mates with a raised portion of the lid edge 3. An alternate latching means utilizing a clasp and shackle rigidly affixed to the lid 4 and side 5 would allow for use of a padlock to additionally secure the memorial lantern when not in use.

FIG. 3 illustrates a preferred construction of the memorial light system. The base box 30 is composed of two sides 5 having overlapped ends 10 rigidly connected to the two perpendicular sides 6 having no overlapping portions. It is preferable that the pieces be welded together to maintain simplicity and speed of construction. However, it is understood that these components may be bolted or riveted together or by some ther suitable means for rigid connection. Base 7 containing eight drain holes 8 having upturned edges 9 at all four sides is rigidly connected to sides 5 and 6 at their bottom inside surfaces such that base 7 is flush with the lower edges of sides 5 and 6.

The preferred material of construction is stainless steel sheet however plastics, fibreglass and foam synthetic materials would also be suitable provided that the appealing design and construction were maintained.

The lantern is composed of attractively finished right angled pieces. Four vertical pieces 12 slanting outwardly are rigidly attached to four planar pieces 16 at their top end and to base 13 at its upwardly turned edges 17. This provides a rigid structure in which glass panels 15 can be securely mounted. As an alternative to glass, suitable high temperature plastics such as "Lexan" may be used. To secure the glass, eight small angled pieces 18 are rigidly mounted to base 17 and each planar cross piece 16. For ventilation, air holes 19 are put in base 17 to permit combustion of the candle without allowing drafts due to gusty weather conditions which might extinguish the flame.

Formed piece 1 is rigidly affixed to the lid 4 and is used to slidably connect the base of the lantern to the lid of the base box. The mating pieces 20 on the lantern base are illustrated in FIG. 5.

Figure 4:
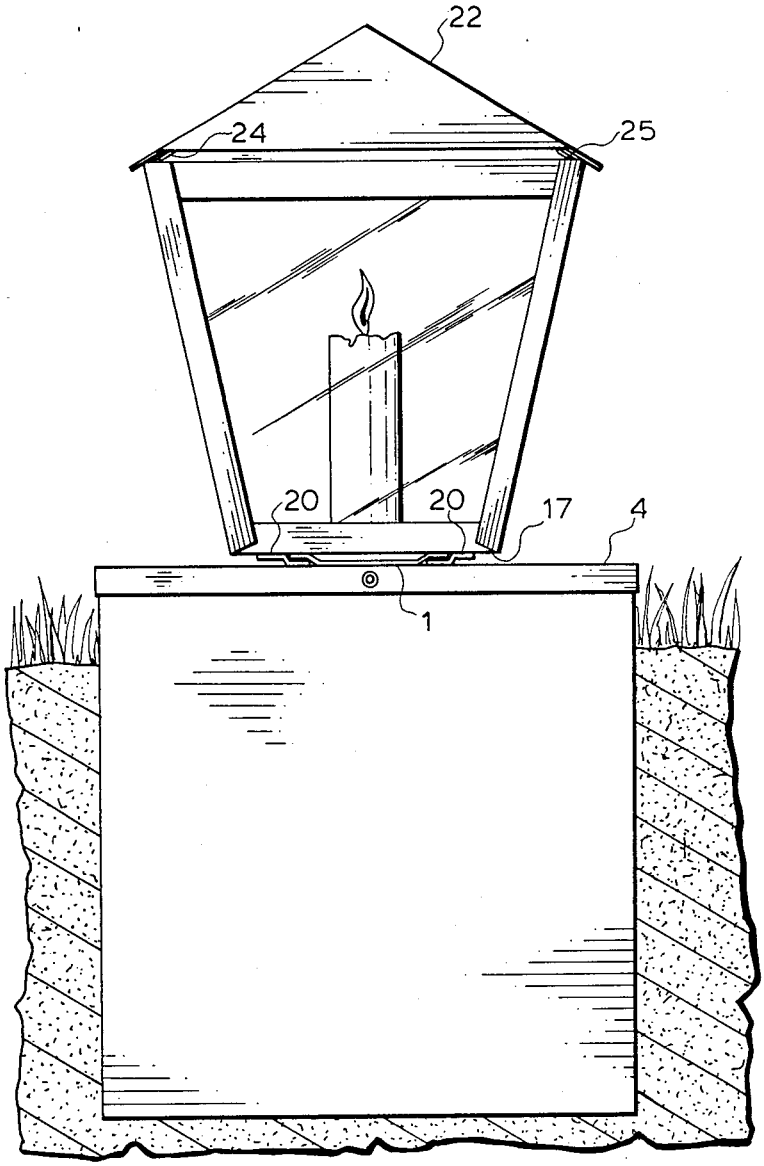
FIG. 4 is a side view of the invention showing the lantern part attached to the base box which is sunken into the earth.

In FIG. 4 the preferred attachment means of the lantern base 17 to the base box lid 4 is readily apparent. Two S-shaped pieces 20 are rigidly attached to the base 17 of the lantern. These are spaced just wide enough apart to frictionally interface with U-shaped piece 1 mounted on base box lid 4. The force required to connect and disconnect the two components of the system is great enough to prevent unanticipated disconnection from, for example, high winds. It can also be seen from FIG. 4 how the lid 22 of the lantern is slidably connected to the lantern body. Extending pieces 25 frictionally engage S-shaped pieces 24 which are securely affixed to lid 22.

It is understood that alternate attaching means may be used to secure the lid 22 to the top of the lantern body such as a hinge and latch mechanism as used to attach the lid of the base box.

Similarly, alternate means could be used to affix the lantern body to the base box lid such as a lock and keyhole system which would involve a 90° turn to securely lock the lantern body into the base box lid. Alternatively, thread attachment means could be used to secure the lantern body to the base box lid.

It can be seen in FIG. 5 how the S-shaped engagement pieces 20 are to be affixed to the base of the lantern 17. These pieces must be parallel and situated precisely enough for there to be sufficient friction when it is engaged with the sliding portion 1 on the lid of the base box.

FIG. 6 illustrates how angle pieces 24 rigidly attached to top 21 are positioned to slidably engage planar pieces 16 having extending pieces 25. In the preferred embodiment, top 22 is formed from sheet stainless steel having two slanting surfaces 21 to which are attached opposing slanting surfaces 23. The result is a sort of peaked roof that is both pleasing to the eye and suitable for keeping the weather from the candle. This top 22 can be easily slidably disengaged from the extending pieces 25 to which it is connected so that the candle 26 may be lit or replaced or to clean the glass of the lantern 15. It may be preferred to use a candle holding fixture which rests on the bottom of the lantern to minimize wax spillage and to securely hold the candle upright.

While my invention has been disclosed herein in one illustrative embodiment thereof, it may be embodied in many forms as will be obvious to those skilled in the art without departing from the spirit of the appended claims.

The embodiments of the invention in which an exclusive property or privilege is claimed are defined as follows:

1. A memorial light system for housing a candle; said system comprising a base box with a lid to provide access therein, a lantern body for housing a candle, said lantern body having a door to permit placement of a candle within said lantern body, said lantern body having a base plate, cooperating means provided on said base plate and on said lid for releasably connecting said lantern body to said lid of said base box.

2. A memorial light system of claim 1 wherein a hinge connects said lid to said base box.

3. A memorial light system of claim 1 wherein said door of said lantern comprises a removable roof portion for said lantern body, means for slidably connecting said roof portion to said lantern body.

4. A memorial light system of claim 1 wherein said releasable connecting means comprises formed pieces attached to base box lid and the lantern base which slidably engage each other.

5. A memorial light system of claim 1 wherein said system is composed of material selected from the group consisting of stainless steel, plastics, fibreglass, foamed synthetic materials, glass, and a high temperature plastic of "Lexan".

6. A memorial light system of claim 1 wherein said lantern body has holes in said base to provide sufficient air circulation.

7. A memorial light system of claim 1 wherein the base box is of sufficient size to fully enclose the lantern body when its use as a memorial light is not required.

* * * * *